US007946879B2

(12) United States Patent
Kaufhold et al.

(10) Patent No.: US 7,946,879 B2
(45) Date of Patent: May 24, 2011

(54) MODIFIED INSULATION DISPLACEMENT CONNECTOR BLOCK

(75) Inventors: Frank Gerwin Kaufhold, Suffolk (GB); Ian Albert Edward Swann, Suffolk (GB); John Richard Willoughby, Essex (GB); George William Francis, Suffolk (GB)

(73) Assignee: United Technologists Europe Limited, Hadleigh, Suffolk (GB)

( * ) Notice: Subject to any disclaimer, the term of this patent is extended or adjusted under 35 U.S.C. 154(b) by 0 days.

(21) Appl. No.: 12/523,136

(22) PCT Filed: Feb. 28, 2008

(86) PCT No.: PCT/GB2008/050136

§ 371 (c)(1),
(2), (4) Date: Jul. 14, 2009

(87) PCT Pub. No.: WO2008/107708

PCT Pub. Date: Sep. 12, 2008

(65) Prior Publication Data

US 2010/0015845 A1 Jan. 21, 2010

(30) Foreign Application Priority Data

Mar. 6, 2007 (GB) ..... 0704301.1

(51) Int. Cl.
*H01R 4/24* (2006.01)

(52) U.S. Cl. ..... 439/404

(58) Field of Classification Search ..... 439/404–408
See application file for complete search history.

(56) References Cited

U.S. PATENT DOCUMENTS 3,848,954 A 11/1974 Sedlacek
4,080,717 A 3/1978 Bunnell

FOREIGN PATENT DOCUMENTS

EP 1 117 158 B1 2/2008

*Primary Examiner* — Khiem Nguyen
(74) *Attorney, Agent, or Firm* — McGarry Bair PC

(57) ABSTRACT

A modified insulation displacement connector block (10) has an array (11) of insulation displacement connectors (12). Each insulation displacement connector (12) is adapted to receive an insulated wire conductor (16) constituting one part of a twisted pair cable (24). The insulation displacement connector block (10) is provided with guide means (17) spaced relative to the connector array (11) so as to define a gap (21) therebetween. The guide means (17) is adapted for aligning each insulated wire conductor (16) with a selected insulation displacement connector (12), and further adapted to receive a length of each insulated wire conductor (16) extending from its selected insulation displacement connector (12) to a corresponding location on the guide means (17). In use, the said length of insulated wire conductor (16) bridges the gap (21), thereby to be presented for subsequent removal by a wire manipulation tool (23).

15 Claims, 3 Drawing Sheets

MODIFIED INSULATION DISPLACEMENT CONNECTOR BLOCK

CROSS-REFERENCE TO RELATED APPLICATIONS

This application is the national phase application from International Application No. PCT/GB2008/050136, filed Feb. 28, 2008, which claims the benefit of British Patent Application GB0704301.1, filed Mar. 6, 2007, both of which are incorporated herein in their entirety.

The present invention relates to a modified insulation displacement connector block for use in telecommunications networks, and to a method of wiring an insulated wire conductor into such a modified insulation displacement connector block. More particularly, the invention relates to an insulation displacement connector block modified for use with an automated or robotic wiring system, and to a corresponding method of wiring an insulated wire conductor into such a modified insulation displacement connector block using an automated or robotic wiring system.

Insulation displacement connector (IDC) blocks (sometimes referred to as "punch blocks") are widely used in the telecommunications industry. The blocks comprise an array of individual connectors, each adapted to receive a length of insulated wire conductor (IWC) cabling, and to form an electrical connection therewith by displacing the insulation on the cabling, usually by means of a connector blade located within each IDC. The principal use of IDC blocks is in telecommunications network distribution frames, which typically comprise parallel banks of blocks connected, respectively, to subscribers' telephone lines, and to active telephone exchange equipment enabling, for example, internet connection. Connection of a particular subscriber to a particular service (e.g. broadband internet) is effected by wiring a selected connector on the subscriber IDC block to a selected connector on the active equipment IDC block. This interconnection of the respective IDC block, commonly referred to as a jumper connection, is typically carried out using twisted pair cabling comprised of a pair of individual insulated wire conductors.

A typical telecommunications network distribution frame can comprise many thousands of individual IDCs, and hence many thousands of individual connections. These connections require constant maintenance, removal, and re-wiring, for example as subscribers join or leave a particular service, or require connection to additional services. Conventionally, the operation of forming jumper connections is performed manually using hand-operated tools, and as a consequence the process tends to be slow, labour intensive and susceptible to error. The introduction of automated or robotic wiring systems is therefore highly desirable.

Conventional designs of IDC block consist essentially of a linear array of IDCs provided in a plastics body. Each connector is usually housed within a slot in the body, and is provided with one or more blades arranged to displace the insulation around the insulated wire conductor (IWC) as it is inserted into the connector. Once inserted, each wire forming the jumper connection, i.e. interconnecting selected IDCs on each of a pair of parallel IDC blocks, is left in place on the distribution frame, with each wire emerging at each end thereof from its respective connector. When located in a telecommunications network distribution frame, many such IDC blocks will be stacked one on top of another to form a bank of such linear arrays.

This conventional arrangement was developed for use in the manual wiring and re-wiring of jumper connections as described above. However, the arrangement does not lend itself to use with automated or robotic wiring systems, for at least two reasons: firstly, the stacking of the IDC blocks one on top of another generally does not allow sufficient space for an automated wiring tool to access the connector arrays; and secondly, the manner in which each wire emerges from its respective connectors does not present a sufficiently large 'target area' for an automated wiring tool to grip the wires for removal, when required.

The present invention seeks to provide a modified insulation displacement connector block which facilitates access to the connector array, and insertion, manipulation and removal of insulated wire conductors, by an automated or robotic wiring tool.

According to a first aspect of the present invention, there is provided a modified insulation displacement connector block having an array of insulation displacement connectors, each said connector being adapted to receive an insulated wire conductor, wherein said block is provided with guide means spaced relative to said connector array so as to define a gap therebetween, said guide means being adapted for aligning each said wire conductor with a selected connector, and further adapted to receive a length of each said wire conductor extending from its selected connector to a corresponding location on said guide means, whereby in use said length of insulated wire conductor bridges said gap, thereby to be presented for subsequent removal by a wire manipulation tool.

The guide means is preferably arranged such that, in use, the length of insulated wire conductor bridging the gap lies in a plane perpendicular to the direction of insertion of the insulated wire conductor into the insulation displacement connector. The 'target area' of the wire conductor presented to a wiring tool is thus increased, so facilitating subsequent removal. The guide means is preferably further adapted to grip each said received length of insulated wire conductor at each of a range of locations corresponding to a selected connector on the block.

The modified IDC block preferably further comprises a plurality of spaced teeth, arranged such that each adjacent pair of spaced teeth defines a connector slot having an insulation displacement connector located therebetween, each said connector slot being adapted to receive an insulated wire conductor therein. The guide means may desirably also comprise a plurality of like spaced teeth, arranged such that each adjacent pair of spaced teeth defines a guide slot, and wherein each said guide slot is aligned with a corresponding connector slot. Most preferably, each guide slot is substantially equal in width with its corresponding connector slot. The teeth defining each connector slot, and each guide slot, preferably have tapered ends to facilitate the insertion of a wire conductor therebetween. Each guide slot is thus adapted to receive and grip each said length of insulated wire conductor extending from the corresponding connector slot, such that each said length of insulated wire conductor bridges the gap, thereby to be presented for subsequent removal by a wire manipulation tool.

In preferred embodiments of modified insulation displacement connector blocks according to the present invention, the array of insulation displacement connectors is generally linear. The guide means is preferably arranged substantially parallel to the connector array, such that the height of the gap is substantially uniform along the entire length of the array. The optimum height of the gap, to enable insertion, manipulation and removal of the wire conductors by an automated wiring tool has been found to be substantially 5 mm. The guide means may be provided above or below the array of insulation displacement connectors, when the modified IDC block is stacked vertically.

According to a second aspect of the present invention, there is provided a method of wiring an insulated wire conductor into a modified insulation displacement connector block having an array of insulation displacement connectors and guide means spaced relative to the array so as to define a gap therebetween, said method comprising the steps of:

arranging a length of insulated wire conductor such that said length bridges the gap between said connector array and the guide means;

aligning said length of insulated wire conductor with a selected insulation displacement connector and a corresponding location on the guide means; and driving said insulated wire conductor into said selected insulation displacement connector in a direction perpendicular to the axis of the insulated wire conductor, thereby effecting displacement of the insulation and forming an electrical connection between the insulation displacement connector and the insulated wire conductor.

The step of driving the insulated wire conductor into its selected insulation displacement connector preferably further effects the gripping of the length of insulated wire conductor by the selected corresponding location (e.g. the teeth of a guide slot) on the guide means, and by the insulation displacement connector itself.

The method according to the second aspect of the present invention preferably further comprises one or more of the following additional steps:

cutting the insulated wire conductor following insertion into the insulation displacement connector, so as to remove excess wire conductor length; and subsequently removing an insulated wire conductor from an insulation displacement connector when the connection is no longer required, by gripping the length of insulated wire conductor bridging the gap, and pulling said length free of the guide means and the insulation displacement connector, in a direction perpendicular to the axis of the insulated wire conductor.

A wire manipulation tool is preferably utilised for the step of driving the insulated wire conductor into its selected insulation displacement connector. More preferably, a wire manipulation tool is utilised for each above recited method step. Most preferably, the same wire manipulation tool is utilised for each recited method step.

In preferred embodiments of the method according to the second aspect of the present invention, the or each wire manipulation tool is an automated wiring tool. Most preferably, the or each wire manipulation tool forms part of a robotic wiring management system.

The scope of the present invention encompasses a method as hereinbefore described of wiring an insulated wire conductor into a modified insulation displacement connector block as hereinbefore described.

In order that the present invention may be fully understood, a preferred embodiment thereof will now be described in detail, though only by way of example, with reference to the accompanying drawings, in which.

Figure 1:
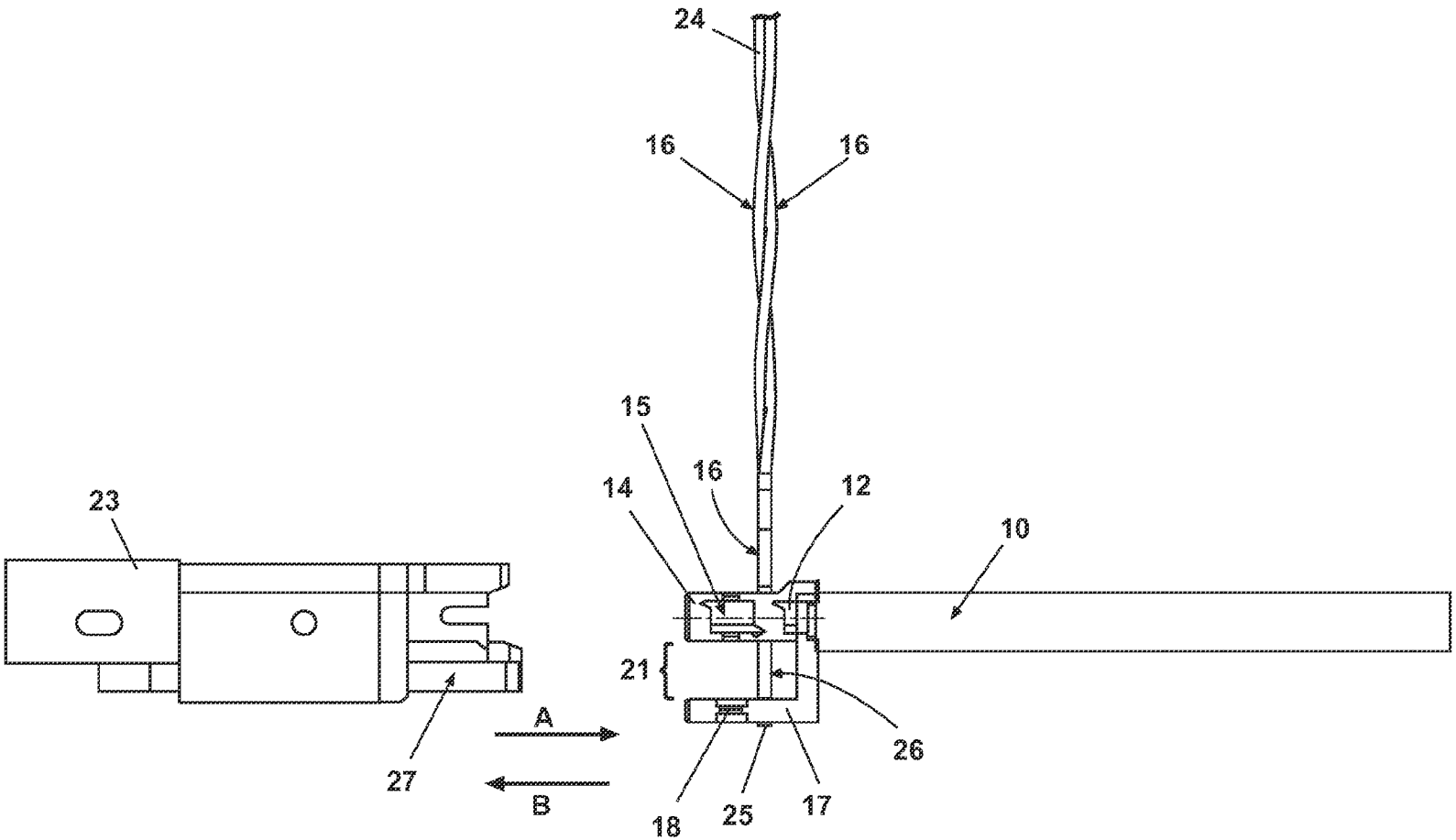
FIG. 1 shows a side view of a modified insulation displacement connector block according to the first aspect of the present invention, and part of an automated wiring tool for performing a method according to the second aspect of the present invention.
Figure 2:
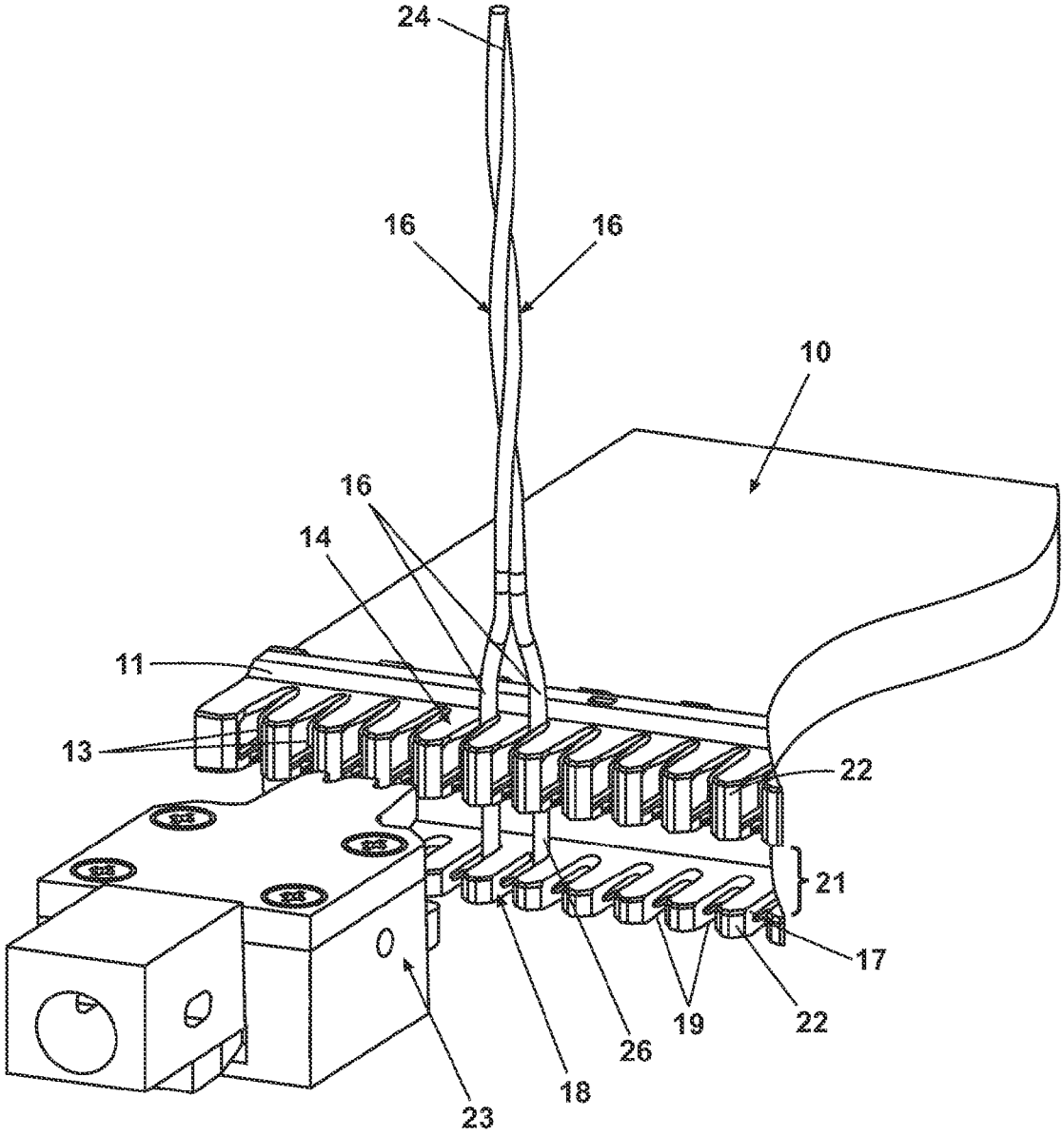
FIG. 2 shows a perspective view from above of the arrangement of FIG. 1.
Figure 3:
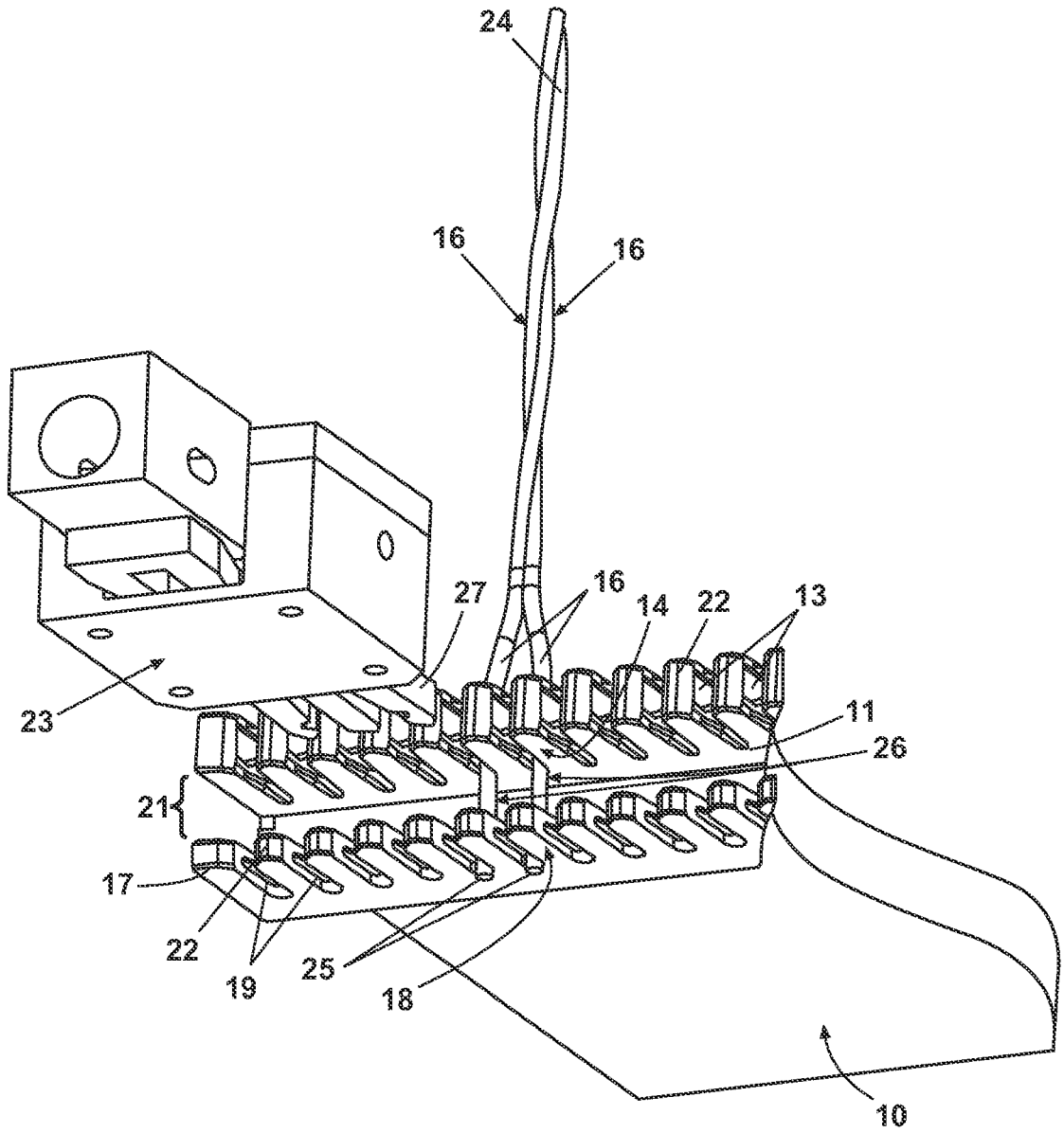
FIG. 3 shows a perspective view from below of the arrangement of FIGS. 1 and 2.

Referring simultaneously to FIGS. 1 to 3, there is shown a modified insulation displacement connector block 10, according to a first aspect of the present invention. The block 10 comprises a linear array 11 of connectors 12, each housed within a connector slot 13. The connector array 11 is provided with a plurality of spaced teeth 14, arranged such that each adjacent pair of teeth 14 defines a connector slot 13 therebetween. In common with conventional insulation displacement connector blocks, each connector slot 13 has one or more blades 15 associated therewith, adapted to displace the insulation of an insulated wire conductor 16, when inserted thereinto, thus enabling the formation of an electrical connection between the wire conductor 16 and the connector 12. As can be seen from FIG. 1, the blade(s) 15 may be mounted in the teeth 14 defining each connector slot 13.

The block 10 is further provided with guide means 17, comprising a plurality of like spaced teeth 18, arranged such that each adjacent pair of spaced guide teeth 18 defines a guide slot 19 therebetween. The guide means 17 is spaced relative to the connector array 11, so as to define a gap 21 therebetween, and is arranged parallel to the array 11, such that the height of the gap 21 is uniform along its length. The optimum height of the gap 21 has been found to be 5 mm. The spaced teeth 18 of the guide means 17 are aligned with the spaced teeth 14 of the connector array 11, so as in turn to align each guide slot 19 with a corresponding connector slot 13. To ensure correct alignment, the width of each guide slot 19 is equal to the width of each connector slot 13. As can also be seen in FIGS. 2 and 3, the teeth 14 of the connector array 11, and the teeth 18 of the guide means 17, are each formed with tapered ends 22 to facilitate the insertion of a wire conductor 16 into the slots 13, 19.

A method, according to a second aspect of the present invention, of wiring an insulated wire conductor 16 into a modified insulation displacement connector block 10 will now be described with reference to FIGS. 1 to 3.

An automated wiring tool 23 is used to present a length of twisted pair cable 24 to a modified connector block 10 on which are terminated cables (not shown) leading to subscribers' telephone lines. The twisted pair cable 24 comprises two individual wire conductors 16, which must be separated for insertion into adjacent connector slots 13 on the modified IDC block 10. An apparatus and method for separating a length of twisted pair cable 24 into its individual insulated wire conductors 16 is described in the applicant's International Patent Application No. PCT/GB2008/050079. It should be appreciated that the automated wiring tool 23 described herein with reference to FIGS. 1 to 3, and the apparatus described in PCT/GB2008/050079, may each form part of the same robotic wiring management system.

With the modified IDC block 10 stacked in a vertical orientation, the automated wiring tool 23 presents the insulated wire conductors 16, 24 from above the block 10 so that the wire conductors 16 are arranged generally vertically. Moving in a generally downward direction, the automated wiring tool 23 locates the conductors 16 in an adjacent pair of pre-selected connector slots 13, corresponding to the telephone line of a particular subscriber, and in a corresponding adjacent pair of guide slots 19 on the guide means 17. The tool 23 then forcibly drives the wire conductors 16 into the block 10, in a direction perpendicular to the axis of the wire conductors 16, as indicated by arrow a in FIG. 1. This causes each wire conductor 16 to be urged past a blade 15, thus displacing the insulation of the wire conductor 16, and into a connector 12, thus forming an electrical connection between connector 12 and conductor 16. At the same time, the driving of the wire conductors 16 into the block effects the gripping of each wire conductor 16 by both the teeth 14 defining the connector slots 13, and the teeth 18 defining the guide slots 19.

The tool 23 includes cutting means (not shown) which are then used to cut off the excess insulated wire conductor 16 below the guide means 17, leaving terminal ends 25 of the conductors 16 held in the guide slots 19, as can best be seen from FIG. 3. The remainder of the insulated wire conductor 16, 24 extends upwardly from the connector block 10, to be connected at its other end to a pre-selected connector slot 13 on another like connector block 10 (not shown) on which are terminated cables leading to selected exchange equipment.

As can be seen in FIGS. 1 to 3, the insertion of each wire conductor 16 as described above, results in a length 26 of each conductor 16, bridging the gap 21 between the connector array 11 and the guide means 17. This length 26 remains in place so long as the connection of the particular subscriber's telephone line to the selected exchange equipment is desired. When the connection is no longer desired, the wire conductors 16 are removed from the connector block 10, by means of wire removal jaws 27 provided on the automated wiring tool 23, as can best be seen from FIG. 3. The jaws 27 are inserted into the gap 21, and grasp the length 26 of wire conductors 16 bridging said gap 21. The automated wiring tool 23 then withdraws from the gap 21, in a direction perpendicular to the axis of the wire conductors 16, as indicated by arrow b in FIG. 1, forcibly pulling the wire conductors 16 free of the guide slots 19 and the connector slots 13, and so breaking the connection between connector 12 and conductor 16.

What is claimed is:

1. A modified insulation displacement connector block having:

a generally linear array of insulation displacement connectors, each said insulation displacement connector being adapted to receive an insulated wire conductor;

a plurality of spaced teeth, arranged on said array such that each adjacent pair of spaced teeth defines a connector slot therebetween, each connector slot having an insulation displacement connector adapted to receive an insulated wire conductor;

a comb-like guide structure spaced relative to, and arranged substantially parallel to, said array so as to define a gap of substantially uniform height between said array and said guide structure along the entire length of said array, said guide structure being adapted for aligning each said insulated wire conductor with a selected insulation displacement connector, and further adapted to receive a length of each said insulated wire conductor extending from its selected insulation displacement connector to a corresponding location on said guide structure;

a plurality of like spaced teeth arranged on said comb-like guide structure such that each adjacent pair of spaced teeth defines a guide slot, and wherein each said guide slot is aligned with a corresponding connector slot on the array;

and wherein each guide slot is adapted to receive and grip each said length of insulated wire conductor extending from the corresponding connector slot, such that each said length of insulated wire conductor bridges the gap, in a plane perpendicular to the direction of insertion of the insulated wire conductor into the insulation displacement connector, thereby to be presented for subsequent removal by an automated wire manipulation tool.

2. The modified insulation displacement connector block of claim 1, in which the comb-like guide structure is further adapted to grip each said received length of insulated wire conductor at each of a range of locations corresponding to a selected connector on said block.

3. The modified insulation displacement connector block of claim 1, in which each guide slot is substantially equal in height with its corresponding connector slot.

4. The modified insulation displacement connector block of claim 1, in which said teeth defining each connector slot and each guide slot have tapered ends to facilitate insertion of an insulated wire conductor therebetween.

5. The modified insulation displacement connector block of claim 1, in which the gap is of substantially 5 mm height.

6. A method of wiring an insulated wire conductor into a modified insulation displacement connector block having a generally linear array of insulation displacement connectors and a comb-like guide structure spaced relative to, and arranged substantially parallel to, said array so as to define a gap of substantially uniform height between said array and said guide structure, along the entire length of said array, said method comprising the steps of:

arranging a length of insulated wire conductor such that said length bridges said gap between said connector array and said guide structure;

aligning said length of insulated wire conductor with a selected insulation displacement connector and a corresponding location on said guide structure; and driving said insulated wire conductor into said selected insulation displacement connector in a direction perpendicular to the axis of the insulated wire conductor, thereby effecting displacement of said wire's insulation and forming an electrical connection between said insulation displacement connector and said insulated wire conductor;

and further comprising a subsequent step of:

removing an insulated wire conductor from an insulation displacement connector when the connection is no longer required, by gripping said length of insulated wire conductor bridging said gap, and pulling said length free of said guide structure and said insulation displacement connector, in a direction perpendicular to the axis of said insulated wire conductor.

7. The method of claim 6, wherein the step of driving said insulated wire conductor into its selected insulation displacement connector further effects gripping of said length of insulated wire conductor by said selected corresponding location on said guide structure.

8. The method of claim 6 further comprising a step of:

cutting said insulated wire conductor following insertion into said insulation displacement connector, so as to remove excess wire conductor length.

9. The method of claim 6, in which an automated wire manipulation tool is utilized for the step of driving said insulated wire conductor into its selected insulation displacement connector.

10. The method of claim 9, in which the automated wire manipulation tool is further utilized for the step of arranging a length of wire conductor such that said length bridges said gap and the step of aligning a length of insulated wire conductor with a selected insulation displacement connector and a corresponding location on said guide structure.

11. The method of claim 8, in which an automated wire manipulation tool is further utilized for the step of cutting said insulated wire conductor.

12. The method of claim 6, in which an automated wire manipulation tool is further utilized for the subsequent step of removing said insulated wire conductor.

13. The method of claim 12, in which the automated wire manipulation tool is utilized for each recited method step.

14. The method of claim 13, in which the same automated wire manipulation tool is utilized for each recited method step.

15. The method of claim 9, in which each automated wire manipulation tool forms part of a robotic wiring management system.

* * * * *